US005666822A

United States Patent [19]

Clare et al.

[11] Patent Number: 5,666,822

[45] Date of Patent: Sep. 16, 1997

[54] AIR SEPARATION

[75] Inventors: Stephen Roger Clare, Bognor Regis; Robert Hartley, Fleet, both of England

[73] Assignee: The BOC Group plc, Windlesham, England

[21] Appl. No.: 559,110

[22] Filed: Nov. 16, 1995

[51] Int. Cl.[6] ..... F25J 3/00

[52] U.S. Cl. ..... 62/646; 62/924

[58] Field of Search ..... 62/924, 647, 646

[56] References Cited

U.S. PATENT DOCUMENTS 4,670,031 6/1987 Erickson ..... 62/924

5,076,823 12/1991 Hansel et al. ..... 62/924

*Primary Examiner*—Ronald C. Capossela

*Attorney, Agent, or Firm*—David M. Rosenblum; Salvatore P. Pace

[57] ABSTRACT

Air is raised in pressure by a compressor and pre-purified by removal of impurities, particularly $H_2O$ vapor and $CO_2$, in an adsorption unit. The resulting air is cooled in a heat exchanger, and is subjected to a first rectification in a rectification column in which the air is separated into a nitrogen-rich fraction and an oxygen-rich fraction. A further oxygen fraction enriched in argon is subjected to a second rectification in which argon is separated from oxygen in a second rectification column. First and second argon products of different purity are withdrawn from the second rectification column through outlets thereof.

6 Claims, 1 Drawing Sheet

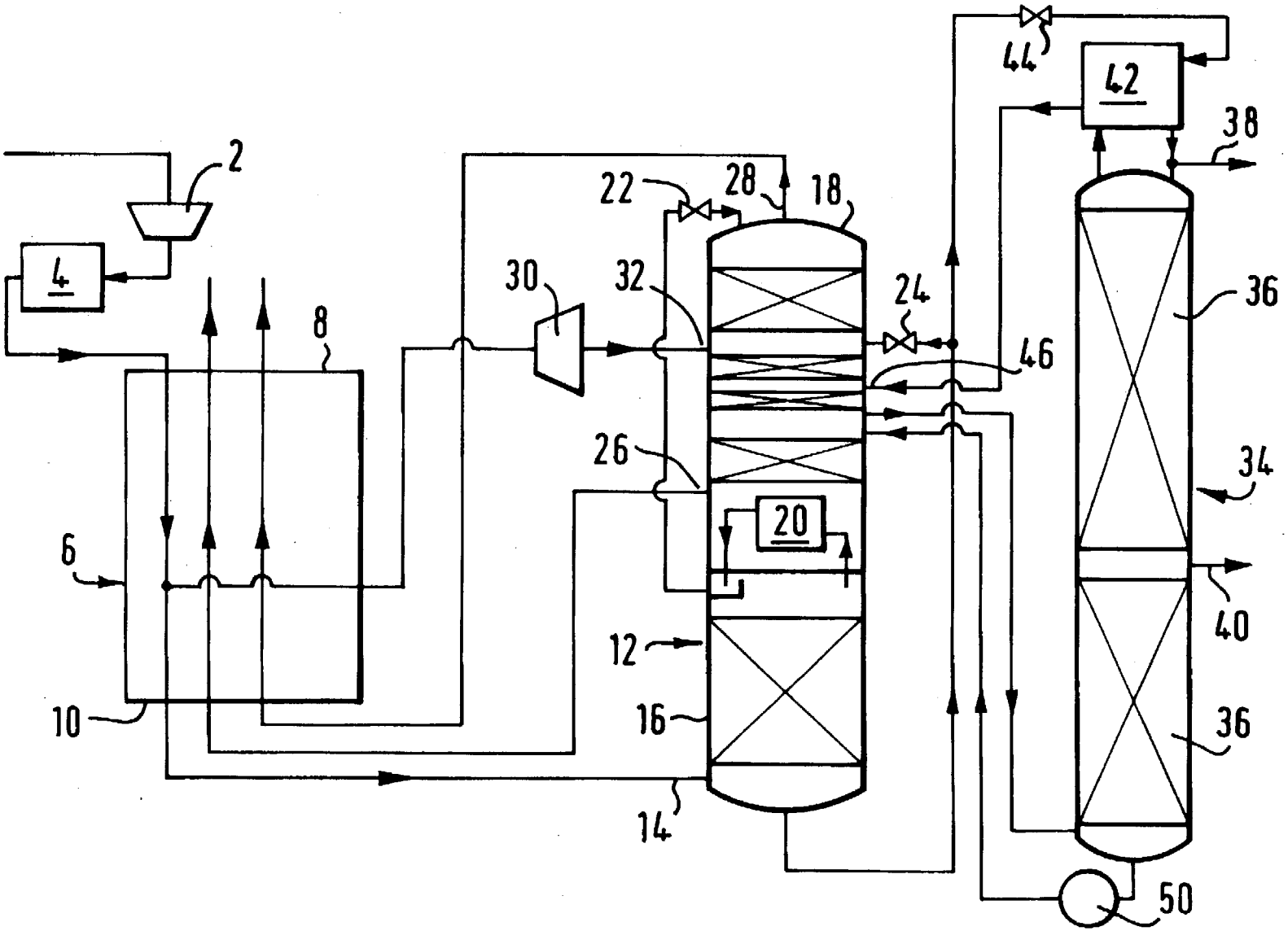
2
4
6
8
10
12
14
16
18
20
22
24
26
28
30
32
34
36
36
38
40
42
44
46
50

AIR SEPARATION

BACKGROUND OF THE INVENTION

This invention relates to air separation.

A well known air separation process comprises compressing a stream of air, pre-purifying the stream of compressed air and cooling it to a temperature suitable for its separation by rectification, subjecting the cooled and purified air stream to a first rectification so as to produce an oxygen-enriched fraction and a nitrogen-enriched fraction, withdrawing an argon-enriched oxygen vapour stream from the first rectification and subjecting it to a second rectification so as to effect a separation as between argon and oxygen and to produce an argon product. The first rectification is typically but not necessarily performed in a double rectification column which comprises a higher pressure rectification column whose top region is in heat exchange relationship with the bottom region of a lower pressure rectification column. The air stream is separated in the higher pressure rectification column into nitrogen vapour and oxygen-enriched liquid air. A feed stream for the lower pressure rectification column is taken from the oxygen-enriched liquid air. The nitrogen vapour is condensed and part of the condensate is used to meet the requirements of the lower pressure rectification column for reflux. The lower pressure rectification column is reboiled by the condensing nitrogen vapour. Oxygen and nitrogen products can therefore be separated in the lower pressure rectification column.

An argon-enriched oxygen vapour stream typically containing from 5 to 15% by volume of argon is withdrawn from an intermediate liquid-vapour contact region of the lower pressure rectification column and introduced into a further rectification column in which the argon is separated. Typically, a crude argon product containing at least 95% by volume of argon and up to about 3% by volume of oxygen with a balance of nitrogen is produced.

Argon and oxygen have similar volatilities. Accordingly, the further rectification column needs to employ quite a large number of distillation plates even to achieve an argon product which is from 95 to 98% pure. It is well known that if one uses conventional distillation plates in the further rectification column it is for practical purposes impossible to reduce the concentration of oxygen in the argon product to less than 10 volumes per million in the further rectification column. Accordingly, in order to produce an argon product of such purity, residual oxygen is conventionally removed by being reacted catalytically with hydrogen to form water vapour, the resulting oxygen-free argon being dried to remove the resulting water vapour and downstream of such drying being further distilled to remove nitrogen and hydrogen impurities.

An improvement to the argon purification process is described in EP-A-0 377 117. In this improvement the further rectification column contains packing in order to effect contact between liquid and vapour. Further, the amount of packing used is sufficient to provide at least 150 theoretical plates in the further rectification column. It is reported in EP-A-377 117 that by employing approximately 180 theoretical plates an oxygen content of less than 1 volume per million in the crude argon product of the further rectification column can be achieved with an economically acceptable argon yield.

EP-A-377 117 further discloses separating nitrogen from the crude argon in the yet further rectification column so as to produce a pure argon product. As disclosed in EP-A 0 520 382, however, very low levels of nitrogen can be achieved in the argon product without resort to this yet further rectification column. Firstly, the nitrogen concentration of the argon-enriched oxygen vapour to the further rectification column can be kept below 50 volumes per million. Secondly, the further rectification column may include an argon-nitrogen separation section above the level of the argon product outlet. Accordingly, the argon product may include less than 10 volumes per million of nitrogen. Thus, if at least 150 theoretical plates are used in the further rectification column (excluding the argon-nitrogen separation) no further purification of the argon product will typically need to be performed.

The key advantage of these improvements is that they eliminate the need for hydrogen, a highly inflammable and explosive gas, to be employed in the vicinity of the air separation plant. On the other hand, the large number of theoretical plates (at least 150) results in an exceptionally tall rectification column. Indeed, in practice, the total height of the column and surrounding thermal insulation has been known to exceed 70 meters.

There is thus a need to provide a method and apparatus for producing argon by rectification which offers the advantage of making the use of hydrogen purification unnecessary but which makes possible the use of shorter distillation columns than those required to produce an argon product of given oxygen purity. The invention aims at meeting this need.

SUMMARY OF THE INVENTION

According to the present invention there is provided a method of separating air comprising compressing, pre-purifying and cooling air and subjecting resulting air to a first rectification in which the air is separated into a nitrogen-rich fraction and an oxygen-rich fraction, withdrawing a further oxygen fraction enriched in argon from the first rectification, and subjecting the further oxygen fraction to a second rectification in which argon is separated from oxygen and from which first and second argon product streams are withdrawn having different oxygen concentrations from one another.

The invention also provides apparatus for separating air comprising means for compressing, pre-purifying and cooling air, at least one first rectification column for separating the air into a nitrogen-rich fraction and an oxygen-rich fraction, having the at least one first rectification column having outlet means for discharging a further oxygen fraction enriched in argon, the outlet means communicating with at least one second rectification column for separating argon from oxygen, the at least one second rectification column having first and second product outlet means for withdrawing product argon streams, the said first and second product outlet means being arranged so as to enable first and second argon product streams having different argon concentrations from one another to be withdrawn.

The method and apparatus according to the invention may be used to produce a first argon product stream containing less than 10 volumes per million of oxygen and a second argon product stream typically containing from 1 to 5% by volume of oxygen. In such an example, the second rectification is preferably performed in one or more packed rectification columns. Withdrawal of such a second argon product stream from the second rectification makes it possible to conduct without loss of argon recovery that part of the second rectification in which the oxygen concentration in the argon is reduced from that of the second argon product to that of the first argon product at a higher liquid/vapour ratio than that employed in the rest of the second rectification. Accordingly, fewer theoretical plates are required in the region of higher liquid/vapour ratio. Indeed, in comparison with a conventional method in which just the first argon product stream is produced, we have surprisingly found that the second rectification can be conducted using a number of theoretical plates reduced by some 15 to 20%.

It is preferred in the method according to the present invention not to subject the second argon product stream to any further purification, particularly one to reduce its oxygen content further. Thus there is no need to provide hydrogen for the catalytic removal of oxygen impurity. Instead, it is preferred to tailor the oxygen concentration to an end use of the second argon product stream. For example, the second argon product stream may be mixed with carbon dioxide and/or helium to form a shielding gas mixture for use in electric arc welding. Such shielding gas mixtures are well known in the welding art. If such a shielding gas is formed it is desirable to conduct the first rectification such that the further oxygen fraction contains less than 50 parts by volume per million of nitrogen.

Another use of impure argon is in the stunning and slaughter of poultry. Methods of stunning and slaughtering poultry are disclosed in EP-A-0 434 278 and EP-A-0 434 279. There are no requirements in such poultry stunning processes to have the argon relatively free of nitrogen. Thus, if the second product argon stream is to be used solely in the stunning and slaughter of poultry it may contain any level of nitrogen impurity, for example either above or below 50 parts by volume per million.

Preferably, the second argon product is withdrawn at a rate in the range of 5 to 50% of the total rate of withdrawal of argon product. The apparatus according to the invention may be designed with the intention that the rate of withdrawal of the second argon product should be substantially constant. In such an example, within the preferred range, the greater the rate of withdrawal of the second argon product, the smaller the number of theoretical plates that may be employed to perform the second rectification.

It is also within the scope of the method according to the invention to withdraw the second argon product discontinuously.

The second argon product may be withdrawn in liquid or vapour state. For reasons of ease of storage, it is generally preferred to withdraw the argon product in liquid state.

BRIEF DESCRIPTION OF THE DRAWINGS

In the method and apparatus according to the invention will now be described by way of example with reference to the accompanying drawing which is a schematic flow diagram of an air separation plant.

The drawing is not to scale.

DETAILED DESCRIPTION

Referring to the drawing, a stream of air is compressed in a compressor 2 typically to a pressure in the range of 5 to 6 bar. The stream of compressed air is subjected to treatment to pre-purify it, by which is meant the removal of relatively low volatility components, particularly water vapour and carbon dioxide, therefrom. In addition, the air is cooled to a temperature suitable for its separation by rectification. As shown in the drawing, the pre-purification is performed by passing the compressed air stream through a purification unit 4 effective to remove water vapour and carbon dioxide therefrom. The unit 4 employs beds (not shown) of adsorbent to effect this removal of water vapour and carbon dioxide. The beds are operated so that the purification is performed continuously. Regeneration of the beds may be performed by purging them with a stream of hot nitrogen. Such purification units in its operation are well known in the art and need not be described further. The purified air is then cooled to a temperature suitable for its rectification by passage through a main heat exchanger 6 from its warm end 8 to its cold end 10. If desired, as an alternative to the purification unit 4, the main heat exchanger 6 may be a reversing heat exchanger which is operable to freeze out and hence remove water vapour and carbon dioxide impurities from the air as it flows therethrough. The compressed, pre-purified and cooled air flows from the cold end 10 of the main heat exchanger 6 into a rectification column 12 through an inlet 14. The rectification column 12 takes the form of a double rectification column comprising a higher pressure stage 16 and a lower pressure stage 18. The top of the higher pressure stage 16 is placed in heat exchange relationship with the bottom of the lower pressure stage 18 by a condenser-reboiler 20. The rectification column 12 is operated so as to perform a first rectification in which the incoming air is separated into nitrogen and oxygen products. Instead of a double rectification column it is possible to use a single rectification column (not shown) as for example illustrated in GB-A-1 258 568. Another alternative is to use a system of three distillation columns all at different pressures from one another to perform the first rectification. (See, for example, EP-A-538 118.)

The higher pressure rectification column 16 employs either sieve trays or a packing in order to effect contact therein between a rising vapour phase and a descending liquid phase. Nitrogen is separated from the air in the higher pressure stage 16. Nitrogen vapour flows from the top of the higher pressure stage 16 and is condensed in condensing passages of the condenser-reboiler 20. Part of the resulting condensate is used as reflux in the higher pressure stage 16. Another part of the liquid nitrogen flow is passed through a throttling valve 22 and is introduced into the top of the lower pressure stage 18 of the double rectification column 12 and acts as reflux in that column. If desired this other part of the liquid nitrogen flow may be sub-cooled upstream of the throttling valve 22.

An oxygen-enriched liquid stream is withdrawn from the bottom of the higher pressure stage 16, and is divided into two subsidiary streams. One subsidiary stream is passed through a throttling valve 24 and is introduced into the lower pressure rectification stage 18 at an intermediate region thereof. As will be discussed below, the second subsidiary stream is used to cool an argon condenser. If desired, the oxygen-enriched liquid stream may be sub-cooled upstream of its division into two subsidiary streams.

The lower pressure stage 18 of the double rectification column 12 typically contains packing or liquid-vapour contact trays in order to effect intimate contact between an ascending vapour phase and a descending liquid phase. Liquid collecting at the bottom of the stage 18 is boiled in boiling passages of the condenser-reboiler 20 in indirect heat exchange relationship with condensing nitrogen. An ascending flow of vapour through the stage 18 is thereby created. An oxygen-rich product (typically containing at least 99% by volume of oxygen) is withdrawn in vapour state from the stage 18 through an outlet 26. A gaseous nitrogen product, typically essentially pure, is withdrawn through an outlet 28 from the top of the lower pressure stage 18 of the rectification column 12. Both the oxygen and nitrogen products are returned through the main heat exchanger 6 from its cold end 10 to its warm end 8 and provide cooling for the incoming air. If the oxygen-enriched liquid and liquid nitrogen streams are to be sub-cooled, this may be effected by their indirect heat exchange in a separate heat exchanger (not shown) with the nitrogen product stream upstream of its flow through the main heat exchanger 6.

In order to create refrigeration for the process a part of the compressed air stream is taken from an intermediate region of the main heat exchanger 6 and is expanded with the performance of external work in an expansion turbine 30. The resultant expanded air stream leaves the turbine 30 at a temperature suitable for its rectification in the lower pressure stage 18 of the rectification column 12. The expanded air stream is supplied to the stage 18 through an inlet 32 and is separated in the stage 18.

The lower pressure stage 18 of the rectification column 12 is typically operated at a pressure typically in the range of 1.2 to 1.5 bar or less at its bottom. At such pressures, a maximum argon concentration in the vapour phase in the order of 15% may be achieved at an intermediate level of the stage 18. An argon-enriched oxygen vapour stream is withdrawn from a selected level of the lower pressure stage 18 of the rectification column 12 and is passed into the bottom of a further rectification column 34 for performing the second rectification, i.e. to separate argon from oxygen. The argon-enriched oxygen vapour typically contains from 5 to 15% by volume of argon. In addition, it typically contains from 20 to 100 volumes per million of nitrogen. The amount of nitrogen impurity depends in part on the height of packing or the number of trays in the lower pressure stage 18 above the level from which the argon-enriched oxygen vapour stream is withdrawn. The greater this height or number the lower the level of nitrogen impurity in the argon-enriched oxygen vapour.

The argon rectification column 34 contains structured packing 36 in order to contact ascending vapour with a descending liquid. The height of packing 36 employed in the argon rectification column 34 depends on the oxygen content desired for the purer of the two argon products that are produced in accordance with the invention. A first, relatively pure, argon product is withdrawn through a first outlet 38 associated with the column 34. A second argon product is withdrawn through a second outlet 40 from the column 34. The withdrawal of the second argon product through the outlet 40 has the effect of increasing the liquid/vapour or reflux ratio in the section of the column 34 above the level of the outlet 40 with the result that fewer theoretical plates are required in this section to achieve a given argon purity. For example, in order to produce an argon product at the top of the column 34 containing in the order of 1 volume per million, typically in the order of 180 theoretical plates may be required if there is no withdrawal of the second argon product. By providing the outlet 40 and withdrawing an argon product continuously therethrough, the argon column 34 may be designed with substantially fewer theoretical plates, that is to say less packing, in order to obtain the same level of oxygen impurity in the argon product obtained at the top of the argon column 34. In order further to facilitate separation of argon and oxygen it is desirable to ensure that the pressure at the top of the column 34 is as close as is practicable to atmospheric pressure, eg in the range 1.05 to 1.10 bar. If necessary, the pressure of the feed may be reduced (eg by passage through a valve (not shown)) to achieve this result.

Reflux for the argon column 34 is provided by condensing argon vapour at the head of the column 34 in a condenser 42. Cooling for the condenser 42 is provided by the other part of the aforesaid oxygen-enriched liquid stream. This stream is passed through a throttling valve 44 upstream of the condenser 42. The oxygen-enriched liquid stream that flows through the condenser 42 is vaporised by the condensing argon and the resulting vapour is introduced into the lower pressure stage 18 of the rectification column 12 through an inlet 46. A part of the condensate from the condenser 42 is used as reflux in the argon column 34 while the rest of it is taken as product through the outlet 38. Liquid is returned from the bottom of the argon column 34 by means of a pump 50 to the low pressure stage 18 oft he rectification column 12.

The outlet 40 is positioned so as to be able to withdraw an argon product of chosen composition from the argon column 34. Typically, it is positioned so as to withdraw a product containing from 1 to 2% by volume of oxygen. This product is preferably withdrawn in liquid state and may be used to form a shielding gas for electric arc welding.

If it is desired to obtain an essentially pure argon product in the outlet 38 of the argon rectification column 34, the argon product withdrawn through the outlet 38 may have nitrogen separated therefrom in a manner analogous to that described in EP-A-0 377 117. Alternatively, the outlet 38 may have a different position from that shown in the accompanying drawing, communicating with a liquid-vapour contact at a level of the argon column 34 below the top such level thereof with an argon-nitrogen separation section being included in the column 34 in a manner analogous to that described in EP-A-0 520 382.

Even though the argon column 34 may have, in effect, a reduced height of packing by virtue of the withdrawal of the second argon product through the outlet 40, it is typically nonetheless a relatively tall installation. If desired, the argon column 34 may be split into two columns (not shown) with vapour from the top of one such column flowing to the bottom of the other and liquid being returned to the top of the one column from the bottom of the other. One advantage of such an arrangement is that it facilitates the withdrawal of the second argon product since it can be taken from the liquid stream flowing between the two columns.

In another possible modification to the apparatus shown in the drawing, the argon column 34 may be provided with a reboiler at its bottom and its feed taken from the lower pressure stage 18 of the rectification column 12 in liquid state.

In yet another possible modification to the apparatus shown in the drawing, instead of employing oxygen-enriched liquid air from the bottom of the higher pressure stage 16 of the rectification column 12 as a source of the liquid which is employed to cool the argon condenser 42, a stream of liquid may be taken for this purpose directly from the lower pressure stage 18.

The method according to the invention is further illustrated by the following example which illustrates the relative amounts of pure and crude argon which can be taken from columns with different numbers of theoretical plates. A feed to the argon column of 10000 $sm^3/hr$ was assumed, with a purity of 90.25% $O_2$, 9.75% Ar and 50 vpm $N_2$. The pressure was 1.38 bar at the bottom and 1.27 bar at the top. Product purities were 1 vpm $O_2$ in the pure argon and 1.8% by volume $O_2$ in the crude argon. The crude argon product contained 17 vpm nitrogen, and the pure argon product contained the balance of the net nitrogen entering the column. The results obtained are set out in the Table below.

| Number of theoretical plates | Pure argon flow ($sm^3/hr$) | Crude argon flow ($sm^3/hr$) | Percent of argon taken pure |
|---|---|---|---|
| 140 | 3 | 336 | 0.9 |
| 150 | 38 | 298 | 11.3 |
| 160 | 145 | 186 | 43.8 |
| 170 | 233 | 94 | 71.3 |
| 180 | 314 | 0 | 100 |

Accordingly, the number of theoretical plates may be selected in accordance with the desired ratio of crude to pure argon.

Reducing the pressure slightly increases the proportion of pure argon that can be taken at a particular theoretical plate count, for example dropping the pressure by 0.1 bar increases the proportion of pure argon from 43.8 to 41.9% when 160 theoretical plates are employed. Increasing the concentration of the oxygen in the pure argon reduces the required tray count by about 30 per factor of 10, so to produce about 44% pure argon, 56% crude argon if the pure argon contains 10 vpm oxygen requires 130 theoretical plates; and if the pure argon contains 100 vpm, 100 theoretical plates are required.

We claim:

1. A method of separating air comprising:

compressing, pre-purifying and cooling air;

subjecting said air to a first rectification in which the air is separated into a nitrogen-rich fraction and an oxygen-rich fraction;

withdrawing a further oxygen fraction enriched in argon from the first rectification; and subjecting the further oxygen fraction to a second rectification in which argon is separated from oxygen and from which first and second argon product streams are withdrawn from said second rectification at different theoretical stages thereof so that said first and second argon product streams have different purities.

2. The method as claimed in claim 1, in which the first argon product stream contains less than about 10 volumes per million of oxygen.

3. The method as claimed in claim 1, in which the second argon product stream contains from about 1 to about 5% by volume of oxygen.

4. The method as claimed in claim 1, in which the second argon product stream is withdrawn continuously at a rate of from between about and about 50% of the total rate of argon product withdrawal.

5. The method as claimed in claim 1, in which the second argon product stream is withdrawn in liquid state.

6. An apparatus for separating air comprising:

means for compressing, pre-purifying and cooling air;

at least one first rectification column for separating the air into a nitrogen-rich fraction and an oxygen-rich fraction;

said at least one rectification column having outlet means for discharging a further oxygen fraction enriched in argon;

said outlet means communicating with at least one second rectification column for separating argon from oxygen;

said at least one second rectification column having first and second product outlet means for withdrawing product argon streams;

said first and second product outlet means being arranged so as to enable first and second argon products having different argon concentrations from one another to be withdrawn.

* * * * *